US005695270A

United States Patent [19]

Collet

[11] Patent Number: 5,695,270

[45] Date of Patent: Dec. 9, 1997

[54] CHEMILUMINESCENT COASTER

[76] Inventor: Marcel-Georges Collet, 57, avenue Jupiter, Forest, Bruxelles B-1190, Belgium

[21] Appl. No.: 530,353

[22] PCT Filed: Apr. 14, 1994

[86] PCT No.: PCT/BE94/00028

§ 371 Date: Dec. 15, 1995

§ 102(e) Date: Dec. 15, 1995

[87] PCT Pub. No.: WO94/23622

PCT Pub. Date: Oct. 27, 1994

[30] Foreign Application Priority Data

Apr. 16, 1993 [BE] Belgium ..... 9300382

[51] Int. Cl.[6] ..... F21K 2/06

[52] U.S. Cl. ..... 362/34; 362/101; 362/253; 215/393; 248/346.11; 252/700

[58] Field of Search ..... 206/219, 221; 215/393; 252/700; 248/346.11; 362/34, 84, 101, 253

[56] References Cited

U.S. PATENT DOCUMENTS

| | | | |
|---|---|---|---|
| Re. 30,103 | 9/1979 | Spector | 362/34 |
| 2,745,947 | 5/1956 | Sansous | 362/101 |
| 3,017,051 | 1/1962 | Rosenfeld | 248/346.11 |
| 3,539,794 | 11/1970 | Rauhut et al. | 362/34 |
| 3,576,987 | 5/1971 | Voight et al. | 362/34 |
| 3,808,414 | 4/1974 | Roberts | 32/34 |
| 3,940,604 | 2/1976 | Rauhut | 362/34 |
| 4,184,193 | 1/1980 | Heffernan et al. | 362/34 |
| 4,405,973 | 9/1983 | Moscarillo | 362/34 |
| 4,563,726 | 1/1986 | Newcomb et al. | 362/34 |
| 4,635,166 | 1/1987 | Cameron | 362/34 |
| 4,678,608 | 7/1987 | Dugliss | 252/700 |
| 4,814,949 | 3/1989 | Elliott | 362/34 |
| 5,010,461 | 4/1991 | Saotome | 362/101 |
| 5,171,081 | 12/1992 | Pita et al. | 362/34 |
| 5,370,828 | 12/1994 | Ladyjensky | 362/34 |

FOREIGN PATENT DOCUMENTS

| | | |
|---|---|---|
| A 0 472 954 | 3/1992 | European Pat. Off. . |
| A 2 233 225 | 1/1991 | United Kingdom . |
| WO A 91 19133 | 12/1991 | WIPO . |
| WO A 92 04577 | 3/1992 | WIPO . |

*Primary Examiner*—Alan Cariaso

*Attorney, Agent, or Firm*—Lowe, Price, LeBlanc & Becker

[57] ABSTRACT

A chemiluminscent coaster includes a coaster combined with a luminous filler or light source, structured as a shell containing reagents for inducing chemiluminescence. At least one surface of the coaster is light transmissive, being wholly or partially transparent or translucent. A single-use chemiluminescent coaster may use light sources in which the reaction takes place extemporaneously at the time of use, or may include light sources wherein pre-mixed reagents are kept at −40° C. in order to prevent any chemiluminescent reaction. Reusable chemiluminscent coasters preferably use extemporaneously chemiluminescent sources. The coaster is structured to permit expansion due to gaseous discharge during the chemiluminescent reaction. A surface thereof may include an opening to permit dilation of the shell, or may be made at least partially of a supple, expandable, material. In the latter case, a raised edge may be provided at the periphery of a supple bottom surface, to permit the coaster to rest flatly on the raised edge whether or not the surface is expanded.

16 Claims, 1 Drawing Sheet

CHEMILUMINESCENT COASTER

BACKGROUND OF THE INVENTION

1. Field of the Invention

This invention relates to coasters, and more particularly to coasters of the type supporting receptacles or drinking glasses, wherein the coaster includes at least one surface that is at least partially light transmissive and further includes a chemiluminescent light source therein.

The coaster which is the subject of this invention is a coaster of which at least one of the surfaces is wholly or partially transparent or translucent, and to which has been associated a chemiluminescent light source in the form of a envelope containing reagents inducing the chemiluminescence, light source which makes either one or both sides of the coaster, intensely luminous for a certain period.

In addition to that indicated by its name, the coaster can be used for purposes other than simply being placed beneath glasses or other receptacles where either the base of the receptacle or the table or support on which the receptacle is resting need to be protected. It can be used for advertising or communication purposes, or for decoration purposes as cocktail accessories in lounge bars, for example.

2. Description of Related Art

Coasters have existed for many years; many types of coaster are manufactured from cardboard with varying levels of absorbency; those which are printed with advertising logos, trade-marks, or advertising messages are generally thrown away quickly and replaced as soon as they have become wet or dirty. There are many other types of coaster; some more expensive types are made of metal, leather, plastic which may be metallized, wood, etc.; in view of their higher price these coasters are manufactured for bar decor and are used regularly to protect the receptacle or the bar itself; they are not objects to be thrown away after use.

In casinos or gaming houses, chemiluminescent coasters can be used in particular as imitations of chips, or high-stake chips, bearing the mark or advertisement of the casino; they have the effect of drawing attention to the size of the sum bet and add a festive air to the casino's atmosphere.

The following provides general information on the phenomenon of chemiluminescence.

The principle and technology of chemiluminescent light production are well known and are amply described in many patents, such as U.S. Pat. No. 4,678,608 dated 7 Jul. 1987 entitled "Chemiluminescent composition" (C. Dugliss).

Chemiluminescence is produced by the reaction of an activator with a fluorescent agent and an oxalate.

It is interesting to note here some interesting characteristics of chemiluminescence reaction that reveal their importance when the invention is applied in practice.

a) Modulation of duration of luminescence

By measuring the doses of the various reagents, chemiluminescence chemistry can modulate the duration and intensity of illumination: it is therefore possible to manufacture luminous charges where the duration of luminosity can be set in advance, clearly only approximately, to last either for a short period of 1 to 2 hours, or a longer period of 6 to 7 hours or more, depending on the user's preference. The longest duration is most likely to be the preferred option in the case of luminous coasters.

b) Physical utilization METHODS of chemiluminescence:

There are TWO physical utilization methods for chemiluminescent light:

The first method, or METHOD A, consists of utilizing chemiluminescent light by extemporaneous mixing of the reagents which is carried out only at the moment the light is required. This first method which may be known as "extemporaneous" makes it possible to store the chemiluminescent object at room temperature in the conditions at which it will be conserved for as long as possible, it should be particularly kept away from damp. In this "extemporaneous" method, it is not absolutely necessary that the separated reagents be both in liquid form, one of them can be in solid form.

The second method or METHOD B involves utilizing ready-mixed reagents in order to produce the chemiluminescent light, but where chemiluminescent reaction is impeded by a sufficiently cold temperature. In fact literature concerning chemiluminescent light indicates that the reaction occurs at temperatures between −40° C. and +75° C., with the best luminous output between +20° C. and +50° C. It is easy to conceive, therefore, that pre-mixed reagents can be utilized (the chemiluminescent liquid and the corresponding activator), preserved at a temperature below −40° C., in carbo-ice, for example.

This method can be known as the "deep-frozen" method.

In summary, there are therefore two methods of utilizing the phenomenon of chemiluminescence in luminous sources placed into coasters, these methods will be considered in the following description.

There are many systems and patents in existence which use the phenomenon of chemiluminescence, principally as a method of lighting or signalling; in this connection we refer to U.S. Pat. No. 3,576,987 dated 4 May 1971 (Chemical lighting device to store, initiate and display chemical light); U.S. Pat. No. 3,940,604 dated 24 Feb. 1976 (Device for emergency lighting); U.S. Pat. No. 4,015,111 dated 25 Sep. 1979 (Inflatable chemiluminescent assembly); U.S. Pat. No. 4,184,193 dated 15 Jan. 1980 (Multi-purpose lantern): U.S. Pat. No. 4,635,166 dated 6 Jan. 1987 (Chemical emergency light); U.S. Pat. No. 4,814,949 dated 21 Mar. 1989 (Chemiluminescent device).

Nowhere within these patents is it indicated that they could be applied to coasters.

With reference to chemiluminescent envelopes, we refer to U.S. Pat. No. 3,539,794 dated 10 Nov. 1970 (Self-contained chemiluminescent lighting device) and U.S. Pat. No. 3,808,414 dated 30 Apr. 1974 (Device for the packaging of a three or more component chemiluminescent system). The various proposals for chemiluminescent envelopes revealed in these patents are currently in the public domain. The present invention claims simply to utilize the concept of these patents, with the necessary and relevant modifications, together with specially adapted coaster models.

In the International Request filed on 30 Aug. 1991 and published under the regime of the Patent Corporation Treaty (PCT) on 19 Mar. 1992 under number WO, A, 92/04577 (Priorities: 9000835 BE dated 30 Aug. 1990 and 9000941 BE dated 4 Oct. 1990), I have described the illumination of the liquid contents in translucent or transparent containers where the chemiluminescent luminous envelope or envelope is interdependent with the base of the container without encroaching on the capacity of the former. In the invention in question, the chemiluminescent devices being interdependent with the recipients for which they have been conceived, there is no claim that they could be stuck to the base of the glasses, nor that they could be included in thick cardboard or in plastic or in all other materials to be used as luminous coasters. Here, the object and the function of this invention are different from those set out in the present specification.

The U.S. Pat. No. 5,171,081 (Pita & Al) dated 15 Dec. 1992 titled "Chemiluminescent reactive vessel" describes a container with double walls which contains, in the void thus formed, one of the reagents of the chemiluminescence to be mixed, at the moment it is used, with the other reagent which is contained in a tube which constitutes the edge of the recipient where the drinker's lips are applied or is contained in a capsule placed in the base of the container. Two patent claims dependent on the initial ones apply the invention to a serving dish; this latter, by its nature itself has to have a certain depth and has a slightly truncated shape. The object and the function of this device are therefore distinct from those of the present invention, which allows a coaster to be illuminated in itself, without the intention of illuminating objects or products that could be placed on its surface.

The International Application PCT/FR90/00367 of which the international publication Number is WO, A, 91/19133 (Guillaume & Al) dated 12 Dec. 1991 (Objet portatif chimiluminescent) describes a chemiluminescent portable object intended to be used as a badge. The intention of using the object as a badge is well indicated by the design itself which is designed not to allow the level of the internal liquid which results from mixing the reagents, to descend from the upper section of the badge, due to the pressure of the light carbonic gas discharge resulting from the reaction, while it is in a vertical position, which is the position it is in when used as a badge; in fact, this descent of liquid level prevents regular illumination of the whole translucent or transparent side of the badge; in addition a projecting reservoir is provided behind the badge which is necessary to create the expansion space for the carbonic gas created by the reaction and to obtain the effect outlined above; this reservoir is a protrusion and ensures that the two sides of the object are not parallel surfaces. The object and the function of that object are different from those of the present invention.

The U.S. Pat. No. 5,010,461 (K. Saotome) dated 23 Apr. 1991 (Multicolor pressure-sensitive illuminating display platform) describes a platform which illuminates an object whose weight triggers the illumination process in a variable choice of colors created by a mobile filter placed between the display platform and a source of electrical light placed in the interior of the device. The object and the function of this relatively expensive device is to illuminate with sufficient electrical power an object placed on the object itself and is different to the object and function of the present invention.

The U.S. Pat. No. 4,814,949 granted to L. Elliott on 21 Mar. 1989 (Chemiluminescent device) and already mentioned above concerning chemiluminescent envelopes describes a chemiluminescent device which includes an absorbent material saturated with a first reagent, and a second reagent contained in a glass ampoule. The second reagent is absorbed in the absorbent material and mixes with the first reagent to give the chemiluminescent reaction when the glass ampoule is broken at the moment of use. The external container and the absorbent material can be applied in different presentations or shapes but the invention concerns a new idea of chemiluminescent envelope and does not anticipate the present invention.

The U.S. Pat. No. 3,017,051 attributed to M. Rosenfeld on 16 Jan. 1962 (Luminescent coaster) describes a system of luminescent coaster whose luminescence is produced by phosphorescent products. These phosphorescent products which are not described in the patent are harmful if they contain phosphorus; they are not harmful if made from zinc or cadmium sulphide but these latter substances give very weak luminescence which requires previous excitation by light; the luminescence intensity by chemiluminescence is far more intense and controllable and its utilization in coasters is not anticipated by the Rosenfeld's invention dating from 1962.

SUMMARY

The various patents which are outlined and studied above have been considered as pertinent in the "International Research Report" made for Application BE 9300382 to which this International Application, which claims priority, relates.

The text and claims of the present Application have been modified to take into account the remarks made in the Research Report, while staying within the framework determined by the priority of the first Application.

The differences between each patent summarized above and the present invention have been pointed out.

It is accordingly an object of the present invention to provide the following advantages relative to the prior art.

a) The invention allows to obtain a new especially luminous coaster owing to the fact that luminosity is caused by chemiluminescence and not by phosphorescence which, as outlined above, gives only weak luminosity and which requires previous light excitation. The coaster which is the subject of this invention contains its own light source which can maintain a strong luminescence for several hours.

b) No patent has been found which claims the use of fluorescent coloring materials on the surface of coasters; this fluorescence, which is not the subject of a claim here, could make special coasters showing pleasant and relatively luminous colors in darkness but which could be designed only for areas specially equipped with black light projectors (Wood's lamp) to activate this fluorescence.

The chemiluminescent coaster is not dependent on external conditions; it can certainly be used anywhere; of course, as with any luminous source of which one wishes to benefit from the effect, this should be in favorable ambient luminosity, and not in full sunlight or in strongly-lit places.

c) The cost price of a chemiluminescent coaster can be greatly decreased if one coaster is used repeatedly where only the luminous charge is replaced at each use. The cost price is also particularly low when it concerns disposable or single-use coasters where reagents are already mixed in advance but where the reaction is impeded by the preserving the coaster at a temperature low enough to stop the chemiluminescent reaction. This formula requires a freezer chain but many establishments are now already equipped with such equipment.

d) The invention offers the practical possibility of occasionally sticking the coaster to the bottom of the glass, beaker, or the tankard by means of a self-adhesive system.

e) Possibilities for advertising are increased and display advertisements have a far higher visual impact. For example, in casinos chemiluminescent coasters can be used to imitate large luminous stacking chips, greatly increasing the pleasure of the game, while remaining usable as a normal coaster when, for example, the luminosity has disappeared.

In this way this invention, such as it is further revealed and characterized in main claim 1 makes great improvements to, and gives unquestionable advantages over existing coasters.

BRIEF DESCRIPTION OF THE DRAWINGS

The accompanying drawings, incorporated into and forming a part of the specification, illustrate several aspects of a preferred embodiment of the present invention and, together with the description, serve to explain the principles of the invention. In the drawings.

In accordance with the foregoing objects and advantages of the invention.

DESCRIPTION OF THE PREFERRED EMBODIMENTS OF THE INVENTION

When considering practical applications for this invention it must be borne in mind that it applies to two models of coaster:

1) THE SINGLE-USE OR DISPOSABLE COASTER and

2) THE MULTI-USE OR REUSABLE COASTER (where the luminescent charge is replaced after each use).

A) Conditions of realization and realization of the SINGLE-USE coaster

The luminescent coaster is a flat element which is designed in its different models in such a way that it can receive a chemiluminescent envelope, either by the "extemporaneous" method or the "deep-frozen" method.

Figure 1:
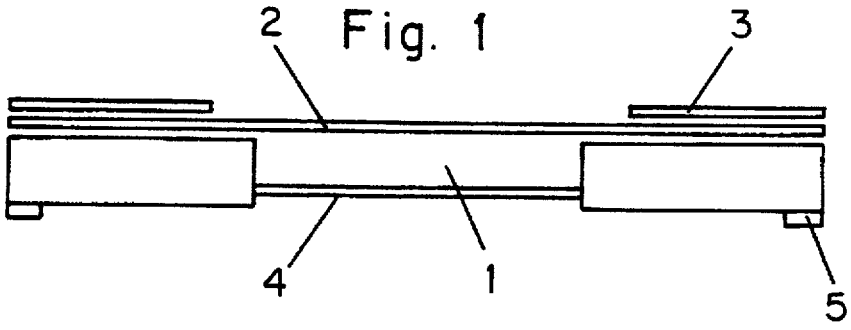
FIG. 1 shows an elevational view of a basic design of the inventive luminescent coaster.

The basic design of the luminescent coaster contains, as can be seen from FIG. 1, a empty space (1) reserved for the insertion of the chemiluminescent envelope.

The chemiluminescent envelope associated with the coaster has to be as flat as possible and thinner than the body of the coaster itself into which it is inserted.

The upper surface of the envelope must be as close as possible to the level of the upper surface of the coaster. These upper surfaces of the chemiluminescent envelope and of the coaster can be covered with cover sheets, one sheet (2) permits the formation of a continuously flat surface which could carry advertisements, the other sheet could be a self-adhesive sheet (3), covered by a protective backing which can be removed.

In consideration of the very light carbonic gas discharge from the reaction, it is necessary to create a space or void beneath the envelope (4), i.e. at the level of its supple lower surface, between this level and the base of the coaster, to ensure that the swelling does not affect the uniformity of the unit and that the base or lower surface of the coaster stays completely level; this space beneath the lower surface could be replaced by regular protuberances (5) or by a raised edge around the perimeter of the coaster which would prevent direct contact of base with the surface onto which the coaster is placed.

To ensure that the light carbonic gas discharge inflates the lower envelope wall rather than the upper wall, the first cover sheet (2) for the upper surface of the unit should be manufactured from a rigid transparent material, plastic, or other suitable material. Its purpose is not only to strengthen and seal the entire object as the top surface of the main body and the upper surface of the chemiluminescent envelope, but also to allow light from the luminous source to pass through and to permit the advertising material to be clearly read.

Figure 2:
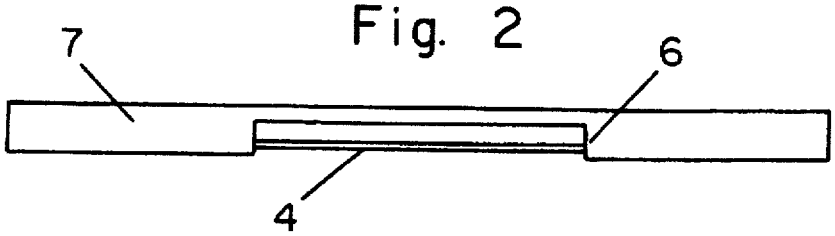
FIG. 2 shows a deep-frozen, disposable, embodiment of the invention.
Figure 3:
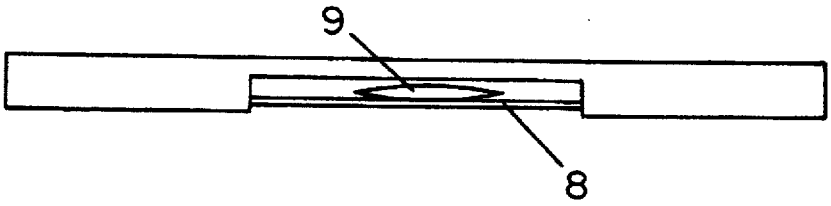
FIG. 3 shows additional details of the embodiment of FIG. 2.

Below we consider an interesting model of a disposable luminescent coaster—"deep-frozen" or "extemporaneous"—which is a variation on the model defined above (see FIG. 2); let us consider a chemiluminescent envelope of parallelipipedic form with 4 vertical side walls connected with the top and base of the envelope; the side walls (6) of the envelope around the completely closed cavity which constitutes the chemiluminescent reaction center of the envelope are continued in the same material, towards the exterior by means of an horizontal prolongation (7) to form a coaster constructed entirely of translucent or transparent plastic material. In this way the luminosity of the chemiluminescent light is generated not only through the upper part via the transparent or translucent upper surface but via the transparent or translucent walls and the base of the envelope which can also be transparent or translucent. The material used to manufacture the cover for the top and the envelope framework would have to be rigid and transparent or translucent and must be the same as that for the chemiluminescence chamber while that for the base (8) of the chamber needs only to be more flexible to enable a pressure to be exerted on it; this pressure would be transmitted to the chamber to trigger the chemiluminescent reaction by breaking the glass ampoule (9) contained in the chamber,—in the case of a "extemporaneous" system model—(see FIG. 3); thanks to the more flexible material, the envelope could expand slightly at the moment of dilation caused by the carbonic gas produced by the reagent. This duality of materials would be easy to produce since the supple part of the base of the chemiluminescence chamber (8) would be sealed after the reagents have been inserted into the chamber; in the case of the "extemporaneous" model, before sealing, one of the reagents would be inserted in either liquid or solid form, and the other in the breakable ampoule preferably in liquid form (obligatory if the other reagent is in solid form); for the "deep-frozen" method, the mixed reagents in liquid form and conserved a very low temperature would be inserted directly into the chamber before its sealing.

It is also necessary to maintain a small space at the base of the reaction chamber in order to allow a light dilatation due to the carbonic gas, or possibly to provide a small raised edge or protuberance, as described earlier, around the lower outline, which would ensure that the coaster remains level during the operation.

The surfaces of the unit, both upper and lower, can be printed or transparent films bearing advertisements can be stuck onto them.

B) Conditions of realization and realization of REUSABLE coasters

This model of coaster is designed in such a way that it allows the insertion of a chemiluminescent envelope into the relevant section of the coaster. When the envelope is not present, it can be used as a non-luminescent coaster.

It is clear that, in this case of the reusable model, only the "extemporaneous" system is acceptable for practical purposes.

The application model shown here is therefore intended to be a non-disposable model, for re-use, and, as shown above, which can also be used as a non-luminescent coaster.

Figure 4:
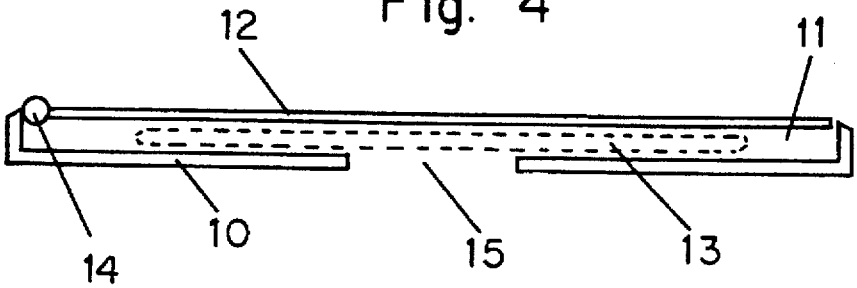
FIG. 4 shows a reusable embodiment of the invention.

FIG. 4 shows a section view of a coaster of this type.

It can be manufactured of relatively rigid plastic or of any other material. The basic element is a receptacle (10) with a cavity (11) intended to receive the chemiluminescent envelope. This receptacle can have feet or regularly-spaced protuberances which prevent the flat base from having direct contact with the surface onto which it is placed.

In this model, the upper part of the receptacle here is closed by a removable lid (12), which is rigid and transparent or translucent and made of plastic or any other transparent or translucent rigid material. This lid contrives with the receptacle an internal chamber which is destined to receive the chemiluminescent envelope (13).

This lid can be attached by ratchet mechanism or by a hinge (14) that allows to it to be raised and lowered to close the cavity.

The base of this coaster may have an opening (15) which would allow the chemiluminescent envelope to be activated if one does not wish to raise the lid (12).

The lower chamber can also be divided in several compartments, two or more, in which can be placed small chemiluminescent enveloppes of same or different colors. This chamber, by instance, could have longitudinal spaces, hollow and parallel, allowing the placement of small chemiluminescent sticks type "Cyalume" on sale generally. The luminescence could be induced at different moments to allow the luminescence to last longer.

The invention is not limited to the application examples which are set out and described in detail here, owing to the fact that several versions can be applied without diverting from the type.

We claim:

1. A coaster comprising:

an upper surface and a lower surface, said upper and lower surfaces defining a first space therebetween, at least one of said upper and lower surfaces being at least partially light transmissive, a source of light in said first space between said surfaces rendering said coaster at least partially luminous, wherein:

said source is chemiluminescent and said upper surface is made of a rigid material to support a drinking glass, said lower surface is made at least partially of a supple material, and a second space is provided adjacent to said lower surface to allow expansion of a gaseous discharge created by a chemiluminescent reaction of said chemiluminescent source.

2. A coaster in accordance with claim 1, wherein said second space is between said lower surface and said source.

3. A coaster in accordance with claim 1, wherein said second space is between said lower surface and a plane at a level of a lower edge of a peripheral border of the coaster.

4. A coaster in accordance with claim 1, wherein said at least one of said upper and lower surfaces being at least partially translucent.

5. A coaster in accordance with claim 1, wherein said at least one of said upper and lower surfaces being at least partially transparent.

6. A coaster in accordance with claim 1 wherein said chemiluminescent light source comprises a translucent or transparent shell including separate compartments preserving reagents inducing chemiluminescence.

7. A coaster in accordance with claim 1 wherein said chemiluminescent light source comprises a light transmissive shell preserving reagents inducing the chemiluminescence in a mixed state and at a temperature selected to impede a chemiluminescence reaction.

8. A coaster in accordance with claim 1 wherein the lower surface has an opening allowing slight dilation of the chemiluminescent shell.

9. A coaster in accordance with claim 1 wherein the coaster is shaped to resemble casino chips.

10. A coaster in accordance with claim 1 wherein one of said upper and lower surfaces is opaque.

11. A coaster in accordance with claim 10 wherein said upper surface is transparent or translucent and is fitted with a self-adhesive material.

12. A coaster in accordance with claim 11 wherein said self adhesive material is transparent.

13. A coaster in accordance with claim 11 wherein said self-adhesive material is protected by an easily removable transparent backing film.

14. A coaster in accordance with claim 1 wherein at least one surface of the coaster carries a logo or an advertising marking.

15. A coaster comprising:

an upper surface and a lower surface, said upper and lower surfaces defining a first space therebetween, at least one of said upper and lower surfaces being at least partially light transmissive, a source of light in said first space between said surfaces rendering said coaster at least partially luminous, wherein:

said source is chemiluminescent and said upper surface is made of a rigid material to support a drinking glass, said lower surface is made at least partially of a supple material, and a second space is provided to allow expansion of a gaseous discharge created by a chemiluminescent reaction of said chemiluminescent source, said second space being between said lower surface and a plane at a level of a lower edge of the coaster.

16. A coaster comprising:

an upper surface and a lower surface, said upper and lower surfaces defining a first space therebetween, at least one of said upper and lower surfaces being at least partially light transmissive, chemiluminescent reagents stored in said first space between said surfaces for rendering said coaster at least partially luminous, wherein:

said upper surface is made of a rigid material to support a drinking glass, said lower surface is made at least partially of a supple material, and a second space is provided below said lower surface to allow for deflection of the lower surface by expansion due to a gaseous discharge created by the chemiluminescent reaction of said chemiluminescent reagents.

* * * * *